United States Patent [19]

Stevenson

[11] Patent Number: 5,022,790

[45] Date of Patent: Jun. 11, 1991

[54] AUDIBLE SIGNALLING SYSTEM FOR DIVERS

[75] Inventor: Robert A. Stevenson, Canyon Country, Calif.

[73] Assignee: Rolyn Productions Inc., Canyon Country, Calif.

[21] Appl. No.: 445,274

[22] Filed: Dec. 4, 1989

[51] Int. Cl.[5] ..... B63C 11/26

[52] U.S. Cl. ..... 405/186; 441/89; 116/27; 116/142 FP

[58] Field of Search ..... 441/89, 92, 96; 405/185, 186; 116/26, 27, 137 R, 142 FR

[56] References Cited

U.S. PATENT DOCUMENTS

| | | | |
|---|---|---|---|
| 3,125,061 | 3/1964 | Liebermann et al. | 116/27 |
| 3,738,446 | 6/1973 | Nottingham | 116/27 |
| 4,529,333 | 7/1985 | Robinette | 405/186 |
| 4,852,510 | 8/1989 | Joseph, Jr. et al. | 116/137 R X |
| 4,858,204 | 8/1989 | Holston et al. | 405/186 X |
| 4,950,107 | 8/1990 | Hancock et al. | 405/186 |

FOREIGN PATENT DOCUMENTS

| | | | |
|---|---|---|---|
| 648308 | 1/1951 | United Kingdom | 441/89 |

*Primary Examiner*—Dennis L. Taylor
*Assistant Examiner*—Arlen L. Olsen
*Attorney, Agent, or Firm*—Kelly Bauersfeld & Lowry

[57] ABSTRACT

An audible signalling system is provided for us by divers or the like to provide a relatively loud audible signal which can be used to indicate diver position, to signal distress, etc. The preferred system utilizes an air horn carried by the diver and adapted for connection to a pressurized air supply carried by the diver for breathing purposes. When the air horn is connected to the air supply, the horn can be operated to produce a loud audio signal of substantial range which can be heard relatively easily over ambient noise such as wind, water and/or boat noise. In one form, a sonic oscillator for use in underwater signalling is also included.

8 Claims, 2 Drawing Sheets

AUDIBLE SIGNALLING SYSTEM FOR DIVERS

BACKGROUND OF THE INVENTION

The present invention relates generally to improvements in diving equipment particularly such as self-contained underwater breathing apparatus, commonly known as "scuba" equipment. More specifically, this invention relates to an effective audible signalling device and system which can be used as a safety or signalling device by divers and the like.

In recent years, scuba diving has become an extremely popular recreational activity enjoyed by an ever increasing number of people. In scuba diving, a diver carries a self-contained supply of compressed air, in combination with an air hose and mouthpiece which permit the diver to breath in a substantially normal manner while underwater. The supply of compressed air is normally contained within a tank adapted to be carried as a backpack, thereby enabling the diver to swim or walk about underwater in a substantially unrestricted manner. Inherent buoyancy provided by the air supply and/or auxiliary equipment such as an insulating wetsuit is normally offset with weights carried by the diver, such as a weighted belt, to permit the diver to descend with minimal effort to a desired depth. Buoyancy compensator vests or the like are often used to alter buoyancy in the course of a dive by appropriate inflation or deflation of air chambers formed in the vest.

Although modern scuba equipment permits virtually anyone to partake in the sport of underwater diving with minimal prior training, diver safety remains an extremely important consideration. In this regard, while scuba diving is relatively safe when the equipment is used properly and safety precautions are observed, a failure to observe seemingly minor precautions can lead to serious and/or life-threatening situations. As one example, underwater currents are often present and can carry a diver significant distances downstream from a diving boat or other start point. As a result, an inattentive or inexperienced diver can be swept through an unexpectedly large distance, whereupon the diver may surface at a location which is surprisingly far from the diving boat. The distance involved can be sufficiently great such that it is difficult for the diver to return to the boat and/or for personnel on the boat to find the surfaced diver.

In the past, conventional whistles have been used by many divers to signal personnel on a diving boat upon resurfacing. In this regard, buoyancy compensation vests often carry a conventional whistle which can be used by the diver as an audio signal at the end of a dive. Unfortunately, however, conventional whistles generally cannot be heard by boat personnel due to relatively high ambient noise levels attributable to wind, water and/or boat noise.

There also exists a need for divers to be able to signal or alert one another while underwater. For example, a diver who becomes caught or trapped within underwater structures such as shipwreck debris or a field of kelp may need to signal a diving companion for assistance. Alternatively, a diver may desire to signal a companion during conditions of poor water visibility or simply to communicate in the course of a dive. Still further, it may be necessary or appropriate to provide a loud audible signal capable of warding off sea animals, such as sharks.

There exists, therefore, a significant need for improvements in audio signalling devices for use by divers and the like, especially with respect to an audio device which has sufficient volume, range and pitch to be heard in a typical wind and water diving environment. Moreover, there exists a need for a signalling device which, in some embodiments, can be adapted for sending audio signals in an underwater environment. The present invention fulfills these needs and provides further related advantages.

SUMMARY OF THE INVENTION

In accordance with the invention, an improved audible signalling device is provided for use by divers and the like. The signalling device comprises a compact and lightweight air horn adapted for carrying by a diver in the course of an underwater dive. The air horn is designed for connection to a compressed air source particularly such as a self-contained air supply carried by the diver for breathing purposes. When the air horn is connected to the air supply, the horn emits an audible blast signal of sufficient range and volume to be heard in an aquatic environment.

In accordance with a preferred form of the invention, the air horn is designed to be carried as an integral part of scuba equipment, such as by attachment to a conventional buoyancy compensator vest or the like. The air horn includes a quick connect fitting to permit relatively rapid coupling with an inflation hose for the buoyancy compensator vest when the hose is disconnected from the vest. In an alternative configuration, the air horn can be connected to the inflation hose via a tee fitting or the like to permit horn operation without requiring the inflation hose to be disconnected from the vest. In another alternative configuration, the air horn can be adapted for suitable connection to other or auxiliary hoses connected to the diver's compressed air supply. In each configuration, the preferred air horn construction includes a resonance chamber having vents positioned for relatively rapid water drainage when the diver surfaces.

In another alternative form of the invention, a sonic oscillator device is connected in series between the diver's compressed air supply and the air horn. The sonic oscillator is designed to emit a vibratory audio signal which can be transmitted and heard while underwater. In this arrangement, therefore, the air horn provides an easily heard audio signal for use at the water's surface, whereas operation of the air horn causes compressed air flow through the sonic oscillator for use in underwater signalling.

Other features and advantages of the present invention will become more apparent from the following detailed description, taken in conjunction with the accompanying drawings which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENTS

Figure 1:
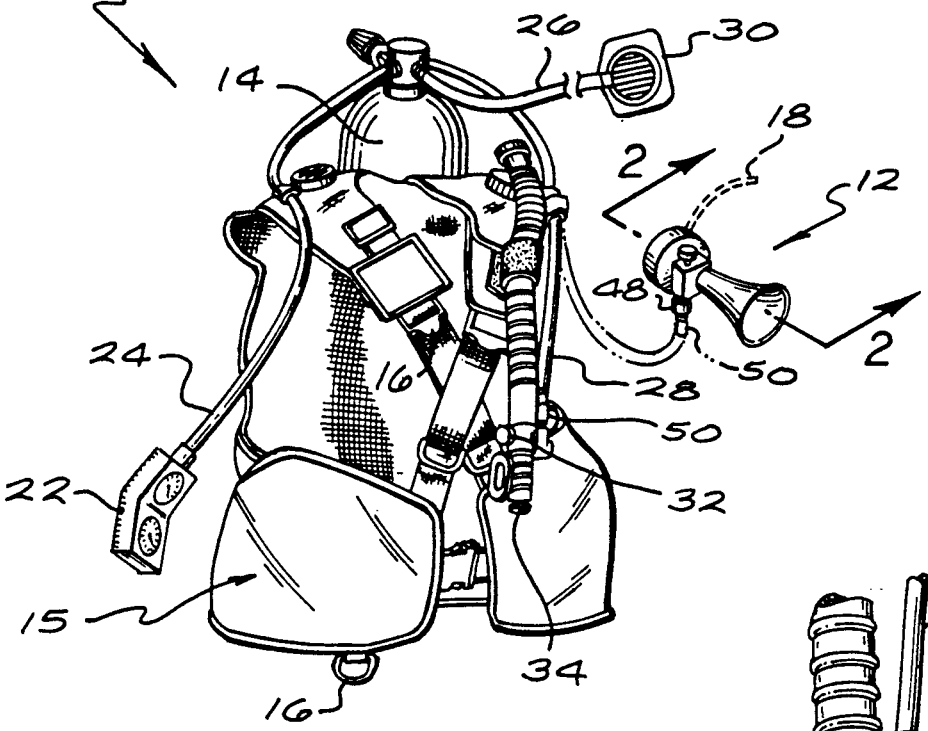
FIG. 1 is a perspective view illustrating scuba diving equipment including an audible signalling system embodying the novel features of the invention.

As shown in the exemplary drawings, an improved audible signalling system for use by divers and the like is referred to generally in FIG. 1 by the reference numeral 10. The signalling system 10 includes a relatively compact and easily carried air horn 12 adapted for connection to a self-contained air supply 14 of the type normally carried by a diver for breathing purposes. In use, the air horn 12 is designed to produce a loud audible signal which can be heard relatively easily notwithstanding the relatively high ambient noise level in a typical aquatic environment.

The signalling system 10 of the present invention is designed particularly for use by scuba divers and the like to provide a location signal upon resurfacing at the conclusion of an underwater dive. The invention produces an audible blast of sufficient volume and range to be heard relatively easily, for example, by personnel on a diving boat to permit the diver to be located quickly and easily. Accordingly, upon resurfacing, the diver can signal the diving boat in a manner which can be heard over and distinguished from the typically high levels of background noise, including noise attributable to wind, water and/or noises related to the operation of boat engines and other equipment. The diver can thus be located and picked up in an expedited manner without requiring the diver to swim on the surface back to the boat. Moreover, the invention provides an effective signalling device which can also be used as an emergency or distress signal, or can be adapted to include a sonic oscillator for use as an underwater signal directed to other divers or to sea animals.

The signalling system 10 of the present invention is designed for a high degree of compatibility with existing diving equipment. In this regard, in accordance with modern scuba diving techniques, the self-contained air supply 14 is normally provided in the form of an air tank which is adapted as part of a backpack or backpack harness for relatively easy portability. As shown in FIG. 1, the air tank is commonly included as a backpack component of a buoyancy compensator vest or jacket 15 having inflatable chambers formed therein. The buoyancy compensator vest 15 is designed to be worn by strapping about the upper torso of a diver, and the vest 15 normally includes a number of auxiliary hooks 16 and/or related straps for use in carrying auxiliary equipment items. In one form, the air horn 12 may include an appropriate strap 18 or other suitable fastening means for easy connection to and carrying by the vest 15.

In accordance with conventional operation of scuba equipment, the air tank 12 is charged with a high pressure supply of air typically at a pressure level of 2,000–3,000 psi. A primary or first stage pressure regulator and valve assembly 20 is mounted on the air tank and is appropriately operated to supply compressed air to various equipment items. One such item normally comprises a pressure gauge 22 which may be supported by the vest 15 and is supplied through a high pressure hose 24 with compressed air from the tank without pressure reduction. Typically, two or more intermediate pressure hoses 26 and 28 are also connected to the first stage regulator 20 and receive compressed air at reduced pressure, normally at about 200 psi, for supply to other equipment items.

The illustrative embodiment shows the intermediate pressure hose 26 connected to a mouthpiece 30 which conventionally includes a second stage regulator for further reducing and regulating the pressure of air inhaled by the diver. FIG. 1 also shows the other intermediate pressure hose 28 coupled to the buoyancy compensator vest 15, with appropriate inflation and deflation valves 32 and 34 being respectively provided to permit the diver's buoyancy to be adjusted during the course of a dive. In this regard, the construction and operation of the various regulator stages are known in the art and may be constructed, for example, according to U.S. Pat. Nos. 3,719,160 or 4,230,140, which are incorporated by reference herein. Moreover, the construction and use of buoyancy compensator vests are also known in the art, with exemplary products being commercially available from U.S. Divers Co., Inc., Santa Ana, California, under the product designation "buoyancy compensators", and Scubapro, a division of Undersea Industries, Rancho Dominguez, California, under the product designation "stabilizing jackets". Still further, additional equipment items such as a secondary back-up mouthpiece (not shown) may be connected to the first stage regulator 20, if desired.

Figure 3:
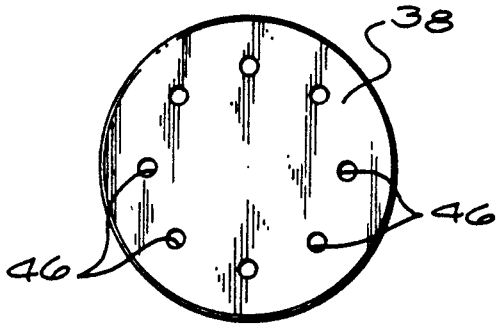
FIG. 3 is an end elevation view taken generally on the line 3—3 of FIG. 2.
Figure 2:
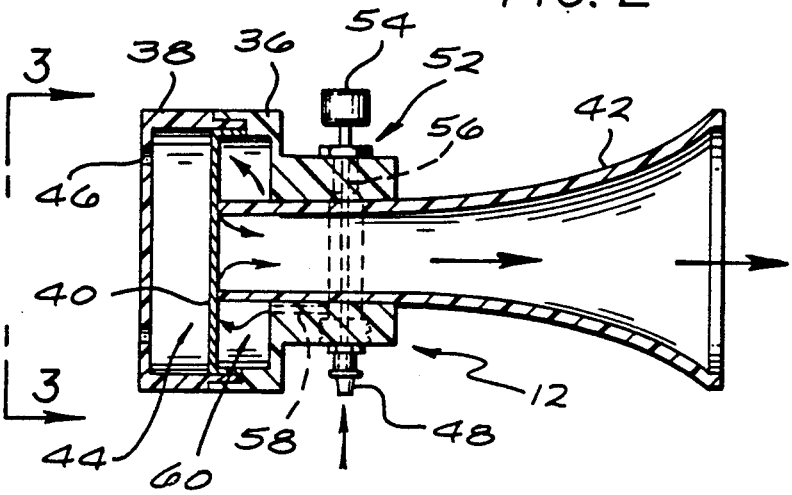
FIG. 2 is an enlarged vertical sectional view taken generally on the line 2—2 of FIG. 1.

As shown in one preferred form in FIGS. 2 and 3, the air horn 12 comprises a relatively compact audio device adapted for economic construction from appropriate plastic and/or stainless steel materials resistant to sea water corrosion, and further adapted for air-powered operation upon rapid connection to the compressed air supply 14 in the backpack tank. More particularly, the illustrative horn 12 comprises a main housing defined by interfitting front and rear housing cups 36 and 38 which are interconnected in facing relation to form a hollow interior. This hollow interior is divided by a central diaphragm 40 formed typically as a thin metal disk to seat normally upon and close the rear end of an elongated discharge trumpet tube 42. The trumpet tube 42 is anchored within and extends from the front housing cup 36. Compressed air is supplied to the horn for flow into the housing interior at the front of the diaphragm 40, whereupon the air causes the diaphragm to flex rearwardly and permit escape through the trumpet tube 42. This air escape causes the diaphragm 40 to reciprocate or vibrate at a relatively high frequency, resulting in an audible output of a volume and pitch in accordance with horn component geometry. A resonance chamber 44 at the rear side of the diaphragm 40 is open to atmosphere via vents 46, and functions to amplify the horn output. Conveniently, the vents 46 are arranged for relatively quick and easy draining of water from the resonance chamber when a diver surfaces.

The air horn 12 is selectively connected to the compressed air supply via a suitable quick connect fitting 48 adapted for rapid connection to a mating quick connect fitting 50 on the low pressure hose 28 connected normally to the buoyancy compensator vest 15 (FIG. 1). A manually operated valve 52 is mounted on the front housing cap 36 and includes a pushbutton 54 adapted to depress a valve stem 56 sufficiently to open a standard Schroeder-type valve (not shown) or the like in the fitting 50 on the hose 28. Such opening of the valve permits compressed air to flow through an inlet port 58 (FIG. 2) into the high pressure chamber 60 of the horn housing to operate the air horn.

Figure 4:
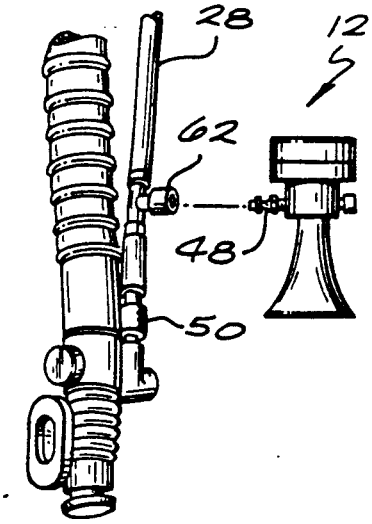
FIG. 4 is a fragmented perspective view similar to a portion of FIG. 1, and illustrating one alternative form of the invention.

Accordingly, when the diver surfaces, or at any other time when horn operation is desired, the diver can connect the air horn 12 quickly and easily to the low pressure hose 28 and then operate the valve 52 to emit a loud audible blast. Alternatively, as viewed in FIG. 4, the air horn 12 can be connected to an appropriate tee fitting 62 or the like mounted along the length of the hose 28, in which case the hose 28 does not require disconnection from the vest 15 in order for the air horn to be operated. As further alternatives, the air horn can be provided in other configurations and/or adapted for permanent or removable connection to any one of the hoses connected to the air supply 14. In all embodiments, the air horn provides a loud and easily recognized audio signal which can be used for immediately locating a diver, or for other communication purposes in an aquatic environment.

Figure 5:
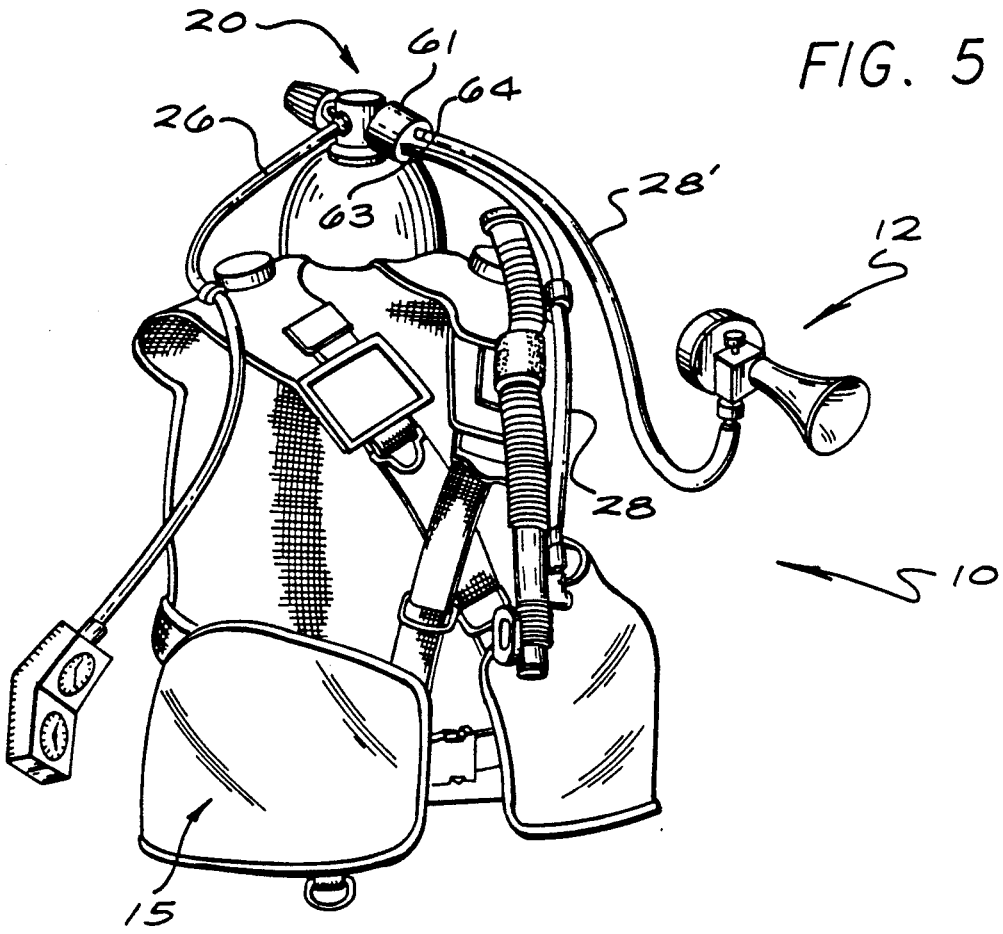
FIG. 5 is an enlarged fragmented perspective view similar to an upper portion of FIG. 1, but depicting an alternative form of the invention to include a sonic oscillator.
Figure 6:
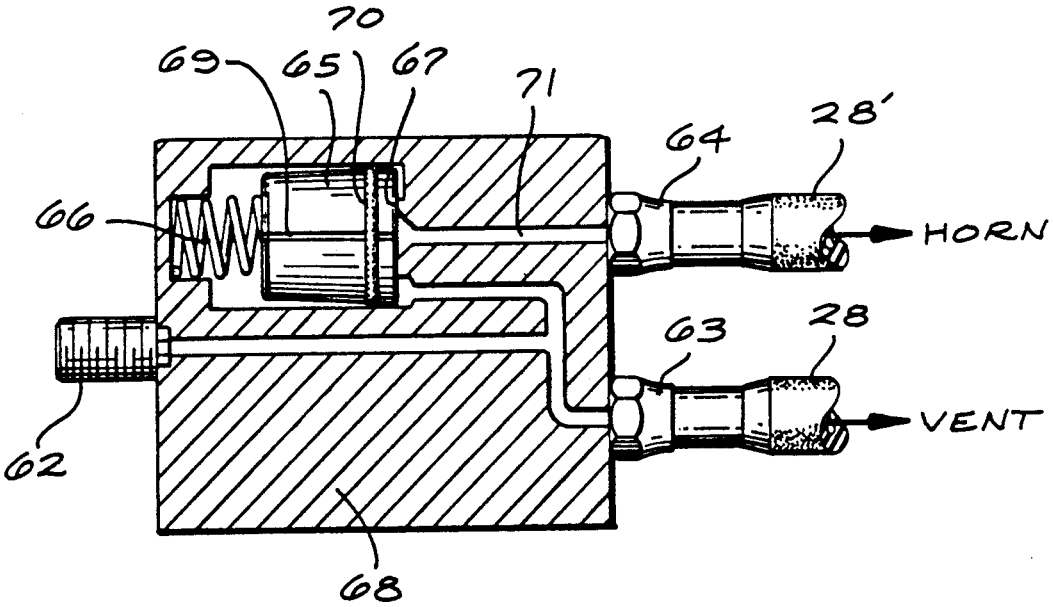
FIG. 6 is a somewhat schematic cross sectional view depicting a preferred oscillator geometry.

FIGS. 5 and 6 illustrate an alternative form of the invention, wherein components corresponding to those shown and described in FIGS. 1–4 are identified by common reference numerals. As shown, the system includes a sonic oscillator 61 having an appropriate fitting 62 for mounting onto the first stage regulator 20. In this regard, FIGS. 5 and 6 show the sonic oscillator having a pair of outlet ports 63 and 64 for respective attachment to hoses 28 and 28' coupled separately and respectively to the buoyancy compensator vest 15 and to the air horn 12. It will be understood, however, that the sonic oscillator 61 may omit the outlet port 63 for connection to the vest 15, provided the regulator 20 includes sufficient ports for direct connection of the vest hose 28 to the regulator 20.

In this alternative embodiment, the sonic oscillator includes an oscillatory valve 65 (FIG. 6) which is normally biased by a spring 66 toward a position closing a seat 67 in an oscillator housing 68. A metering orifice 69 in the valve permits pressure equilibrium on both sides of the valve 65 over a period of time, and an O-ring seal 70 about the valve prevents rapid air bypass around the valve exterior. A housing channel 71 communicates with the orifice 69, such that a substantial pressure drop occurs at the downstream side of the valve when the air horn push button 54 (FIG. 2) is depressed for horn operation. This pressure drop causes the oscillator valve 65 to unseat and then oscillate in a continuous rapid manner due to the cooperative action of the metering orifice 69 and spring 66. An audio signal is produced by the valve 65 audibly slamming against the seat 67, with the specific tone being related to orifice size and spring design.

In practice, it has been noted that lower frequency tones enhance location of the sound source when operated underwater, whereas high tones tend to be audible for greater distances and are more readily distinguishable from background noise. Selection of the optimum frequency may tailor the unit for signalling, or for use as a safety device to ward off sharks, etc.

A variety of further modifications and improvements to the invention will be apparent to those skilled in the art. For example, the air horn and sonic oscillator may be used separately, or in combination, or integrated into a single housing unit for separate and/or simultaneous operation. However, mounting of the oscillator housing 68 onto the first stage regulator 20 beneficially uses the tank 14 (FIG. 1) as a resonant chamber for enhanced sound production. As further alternatives, the air horn and/or the sonic oscillator may be manufactured as separate components or as components integrated with the buoyancy compensator vest, the mouthpiece, the air supply tank, or the first or second stage regulators used in the scuba system. Accordingly, no limitation on the invention is intended by way of the foregoing description or the accompanying drawings, except as set forth in the appended claims.

What is claimed is:

1. An audible signalling system for divers, comprising:

a tank having a supply of air under pressure contained therein and adapted to be carried by a diver;

means for delivering air from said tank to the diver for breathing;

a sonic oscillator mounted generally on said tank, said sonic oscillator including a housing defining a flow path for passage of air under pressure from said tank, and a valve means, mounted along said flow path, for generating an audible sound by oscillatorily contacting a valve seat defined by said housing, whereby an audible sound is resonated through said tank upon passage of air under pressure through said flow path; and control valve means for selectively connecting said sonic oscillator flow path to said tank for passage of air under pressure through said flow path.

2. The signalling system of claim 1 further including a first stage pressure regulator mounted on said tank, said sonic oscillator housing being mounted onto said first stage pressure regulator.

3. The signalling system of claim 2 wherein said sonic oscillator housing includes an inlet fitting connected to said first stage pressure regulator and communicating with one end of said flow path, and an outlet fitting communicating with an opposite end of said flow path, and further wherein said control valve means comprises an air hose having an end connected to said outlet fitting and a manually operable control valve mounted at an opposite end of said air hose.

4. The signalling system of claim 3 further including an air horn mounted at said opposite end of said air hose, said control valve being manually operable to control passage of the air under pressure through said flow path and further through said air horn, said air horn including means for generating a loud audible blast in an above-water environment.

5. The signalling system of claim 4 wherein said air horn includes an air horn housing defining an air horn resonance chamber, and vent means for draining water from said resonance chamber when said air horn is moved from a submerged to an above-water position.

6. The signalling system of claim 2 wherein said air delivering means comprises an air hose having one end connected to said first stage pressure regulator, and a mouthpiece connected to an opposite end of said air hose.

7. The signalling system of claim 1 wherein said sonic oscillator further includes spring means for biasing said oscillating valve for normal engagement with said valve seat.

8. The signalling system of claim 7 wherein said sonic oscillator housing includes an inlet flow path portion for flow of the air under pressure to said oscillatory valve and an outlet flow path portion for flow of the air under pressure from said oscillatory valve, said inlet and outlet flow path portions communicating with a common side of said oscillatory valve, said valve seat separating said inlet and outlet flow path portions when said oscillatory valve is in engagement with said valve seat, said oscillatory valve including orifice means connected between said outlet flow path portion and an opposite side of said oscillatory valve for equilibrating pressure on opposite sides of said oscillatory valve when said control valve means is in a closed position to permit said spring means to retain said oscillatory valve engaged with said valve seat, and said control valve means being selectively movable to an open position to reduce the pressure within said outlet flow path portion and permit the pressure within said inlet flow path portion to unseat said oscillatory valve and thereby initiate oscillatory valve motion.

* * * * *